US007628270B1

(12) United States Patent
Davis

(10) Patent No.: US 7,628,270 B1
(45) Date of Patent: Dec. 8, 2009

(54) GOLF BAG SYSTEM

(76) Inventor: Morris B. Davis, 2946 Banyan Hill La., Land O' Lakes, FL (US) 34639

( * ) Notice: Subject to any disclaimer, the term of this patent is extended or adjusted under 35 U.S.C. 154(b) by 420 days.

(21) Appl. No.: 11/546,193

(22) Filed: Oct. 11, 2006

Related U.S. Application Data

(63) Continuation-in-part of application No. 10/847,506, filed on May 17, 2004, now abandoned.

(51) Int. Cl.
*A63B 55/00* (2006.01)

(52) U.S. Cl. ..... 206/315.7; 206/315.3; 206/315.8; 248/96

(58) Field of Classification Search ... 206/315.3–315.8; 248/96
See application file for complete search history.

(56) References Cited

U.S. PATENT DOCUMENTS

| | | | | | |
|---|---|---|---|---|---|
| 1,970,849 | A * | 8/1934 | Gunther | ..... | 248/96 |
| 1,978,230 | A * | 10/1934 | Sehutes | ..... | 248/96 |
| 2,324,439 | A * | 7/1943 | Thommen | ..... | 248/96 |
| 2,327,736 | A * | 8/1943 | Pearson | ..... | 248/96 |
| 5,082,218 | A * | 1/1992 | Hoffman | ..... | 248/96 |
| 5,472,084 | A * | 12/1995 | Aliano, Jr. | ..... | 206/315.3 |
| 5,613,604 | A * | 3/1997 | Maeng | ..... | 206/315.7 |
| 6,126,050 | A * | 10/2000 | Aliano, Jr. | ..... | 224/274 |
| 6,386,362 | B1 * | 5/2002 | Cheng | ..... | 206/315.3 |
| 2002/0017471 | A1 * | 2/2002 | Rhee | ..... | 206/315.7 |
| 2004/0026279 | A1 * | 2/2004 | Miller | ..... | 206/315.2 |

* cited by examiner

*Primary Examiner*—Tri M Mai
(74) *Attorney, Agent, or Firm*—Edward P. Dutkiewicz

(57) ABSTRACT

An attachable golf bag has a hollow upper tube with a free upper end and a hollow lower tube with a free lower end. The attached golf bag has a pair of rods. The rods join the upper and lower tubes with a cloth cover. A leg assembly includes an upper support. The upper support is attached to the upper tube. A pair of legs have upper ends. The upper ends are pivotally secured to the upper support. The legs are adapted to move between a retracted orientation and an extended orientation. The attachable golf bag is adapted to releasably couple with a main golf bag.

1 Claim, 3 Drawing Sheets

GOLF BAG SYSTEM

RELATED APPLICATION

This application is a continuation-in-part of U.S. patent application Ser. No. 10/847,506 filed May 17, 2004 now abandoned, the subject matter of which is incorporated herein by reference.

BACKGROUND OF THE INVENTION

1. Field of the Invention

The present invention relates to a golf bag system and more particularly pertains to allowing a golfer to transport a lesser number of golf clubs in an attachable golf bag.

2. Description of the Prior Art

The use of golf accessories of known designs and configurations is known in the prior art. More specifically, golf accessories of known designs and configurations previously devised and utilized for the purpose of proving assistance to golfers through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,978,230 issued Oct. 23, 1934 to Schutes relates to a Golf Bag Supporting Means. U.S. Pat. No. 2,327,736 issued Aug. 24, 1943 to Pearson relates to a Golf Bag Support. U.S. Pat. No. 2,768,668 issued Oct. 30, 1956 to Santosuosso relates to a Golf Bag and Support. Lastly, U.S. Pat. No. 5,082,218 issued Jan. 21, 1992 to Hoffman relates to a Container Stand.

While these devices fulfill their respective, particular objectives and requirements, the aforementioned patents do not describe a golf bag system that allows allowing a golfer to transport a lesser number of golf clubs in an attachable golf bag.

In this respect, the golf bag system according to the present invention substantially departs from the conventional concepts and designs of the prior art, and in doing so provides an apparatus primarily developed for the purpose of allowing a golfer to transport a lesser number of golf clubs in an attachable golf bag.

Therefore, it can be appreciated that there exists a continuing need for a new and improved golf bag system which can be used for allowing a golfer to transport a lesser number of golf clubs in an attachable golf bag. In this regard, the present invention substantially fulfills this need.

SUMMARY OF THE INVENTION

In view of the foregoing disadvantages inherent in the known types of golf accessories of known designs and configurations now present in the prior art, the present invention provides an improved golf bag system. As such, the general purpose of the present invention, which will be described subsequently in greater detail, is to provide a new and improved golf bag system and method which has all the advantages of the prior art and none of the disadvantages.

To attain this, the present invention essentially comprises a golf bag system. First provided is an attachable golf bag. The attachable golf bag has a hollow upper tube. The hollow upper tube has a free upper end and an exterior peripheral surface. The attachable golf bag has a hollow lower tube. The hollow lower tube has a free lower end and an exterior peripheral surface. The tubes have parallel linear side edges. The linear side edges are about 5 inches in length. The tubes have semicircular end edges. The semicircular end edges are about 2 inches in diameter. An opening having a major length of about 7 inches and a major width of about 2 inches is thus formed for receiving golf clubs. An area of about 13 square inches is provided for receiving up to 10 golf clubs. The attachable golf bag has a pair of rods. The rods are preferably fabricated of metal with limited flexibility. The rods are about 7 inches apart. The rods join the end edges of the upper and lower tubes to form an attachable golf bag of about 34 inches in height, about 5 times the major length, plus or minus 10 percent, and about 17 times the major width, plus or minus 10 percent. A cloth cover is provided. The cloth cover encompasses the peripheral surfaces of the tubes and the area there between and the lower end of the lower tube.

A pocket is provided. The pocket is attached to the cover in proximity to the lower tube. The pocket is adapted to carry golf balls and tees and other items of interest to a golfer. A handle is provided. The handle is attached to the cover in proximity to the upper tube. In this manner carrying the attachable golf bag is facilitated. Rings are provided. The rings are secured to the upper and lower tubes on opposite sides of the handle. In this manner a carrying strap may be removably received.

Provided next is a leg assembly. The leg assembly includes an upper support. The upper support is attached to the upper tube on a side of the cover opposite from the pocket. The leg assembly includes a pair of legs. The legs have upper ends and free lower ends. The upper ends are pivotally secured to the upper support at a location spaced downwardly from the upper end of the upper tube free lower ends at a location spaced upwardly from the lower end of the lower tube. The legs are adapted to move between a retracted orientation adjacent to the cover and an extended orientation remote from the cover. The legs have upper extents 54 and lower extents. A bend is provided between the upper and lower extents. The upper extents are adapted to converge from their upper ends when in the retracted orientation and to diverge from adjacent to the bend when in the extended orientation. The lower extents are adapted to be essentially parallel when in the retracted orientation and to diverge when in the extended orientation.

A strap of a hook and loop fastener is provided. The strap is secured to the cover beneath the upper support in proximity to the lower tube. The strap has a separable section adapted to secure the legs when in a retracted orientation. A V-shaped bracket is provided. The V-shaped bracket has free ends. The free ends are pivotally attached to the legs adjacent to the bend. The V-shaped bracket has a central pivot point. The central pivot point is movable between a linear horizontal position when in an extended orientation and an overlapping essentially vertical position when in a retracted orientation. The legs are pivotable with respect to the upper support remote from the cover. In this manner a downwardly facing attachment space is provided for securement to a main golf bag.

Further provided is an essentially rigid hook. The hook is in an inverted U-shaped orientation. The hook has an interior component. The interior component is secured to the upper tube opposite from the upper support. The hook has an exterior leg. The exterior leg is spaced from the cover to create a downwardly facing attachment space.

Provided last is a main golf bag. The main golf bag has an upper end. The upper end has an opening. The opening has an area of greater than 36 square inches, greater than 150 percent of the area of the upper tube of the attachable golf bag. In this manner a larger number of golf clubs may be received than the attachable golf bag. The main golf bag has a closed lower end. The closed lower end supports a larger number of golf clubs. The main golf bag has a first side with a pocket and an opposite second side. The opening at the second side is adapted to removably receive, in a first position, the legs of the attachable golf bag and. In a second position, the second side is adapted to receive the exterior leg of the hook.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf bag system which has all of the advantages of the prior art golf accessories of known designs and configurations and none of the disadvantages.

It is another object of the present invention to provide a new and improved golf bag system which may be easily and efficiently manufactured and marketed.

It is further object of the present invention to provide a new and improved golf bag system which is of durable and reliable constructions.

An even further object of the present invention is to provide a new and improved golf bag system which is susceptible of a low cost of manufacture with regard to both materials and labor, and which accordingly is then susceptible of low prices of sale to the consuming public, thereby making such golf bag system economically available to the buying public.

Even still another object of the present invention is to provide a golf bag system for allowing a golfer to transport a lesser number of golf clubs in an attachable golf bag.

Lastly, it is an object of the present invention to provide a new and improved golf bag system. An attachable golf bag has a hollow upper tube with a free upper end and a hollow lower tube with a free lower end. The attached golf bag has a pair of rods. The rods join the upper and lower tubes with a cloth cover. A leg assembly includes an upper support. The upper support is attached to the upper tube. A pair of legs have upper ends. The upper ends are pivotally secured to the upper support. The legs are adapted to move between a retracted orientation and an extended orientation. The attachable golf bag is adapted to releasably couple with a main golf bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
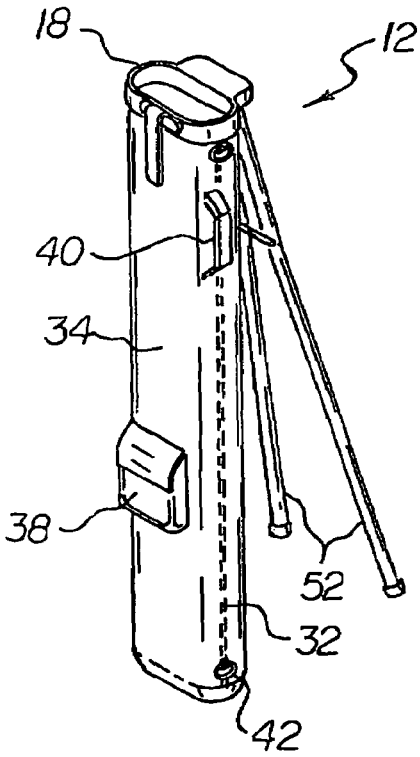
FIG. 1 is a perspective illustration of an attachable golf bag constructed in accordance with the principles of the present invention.
Figure 2:
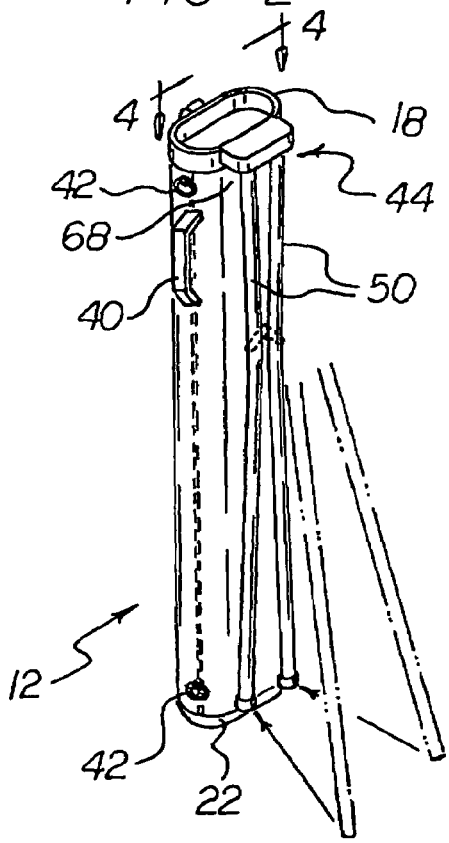
FIG. 2 is a perspective illustration of the attachable golf bag shown in FIG. 1 but with the legs retracted, portions of the legs extended are shown in broken line configuration.
Figure 3:
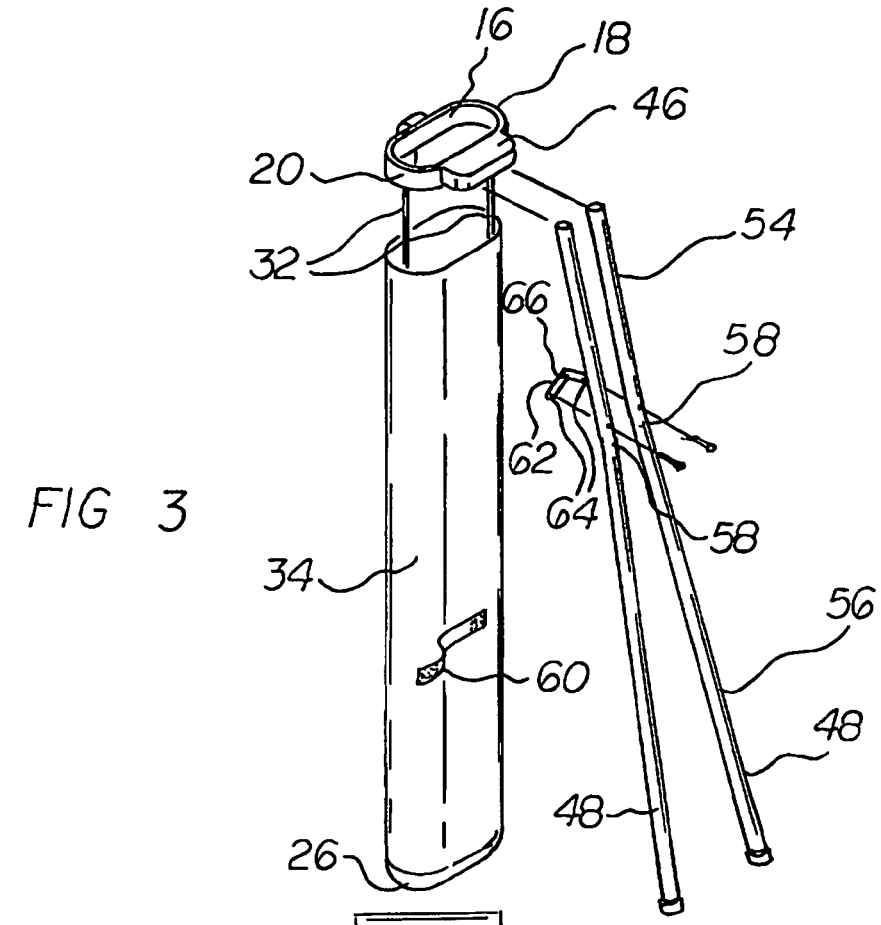
FIG. 3 is an exploded perspective illustration of the attachable golf bag shown in FIGS. 1 and 2.
Figure 4:
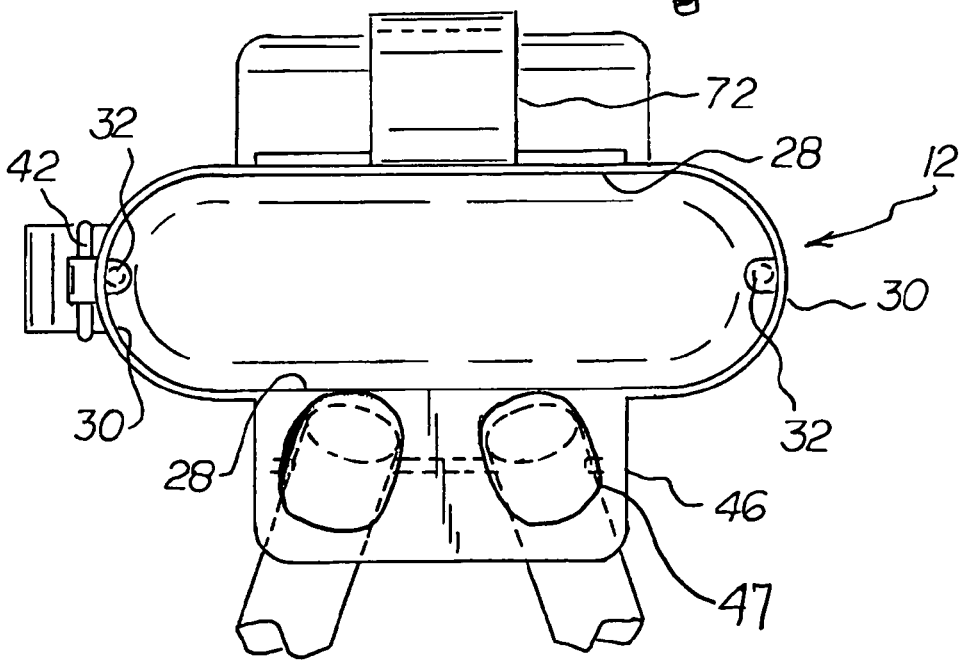
FIG. 4 is a plan view of the attachable golf bag taken along line 4-4 of FIG. 2.
Figures 5, 6:
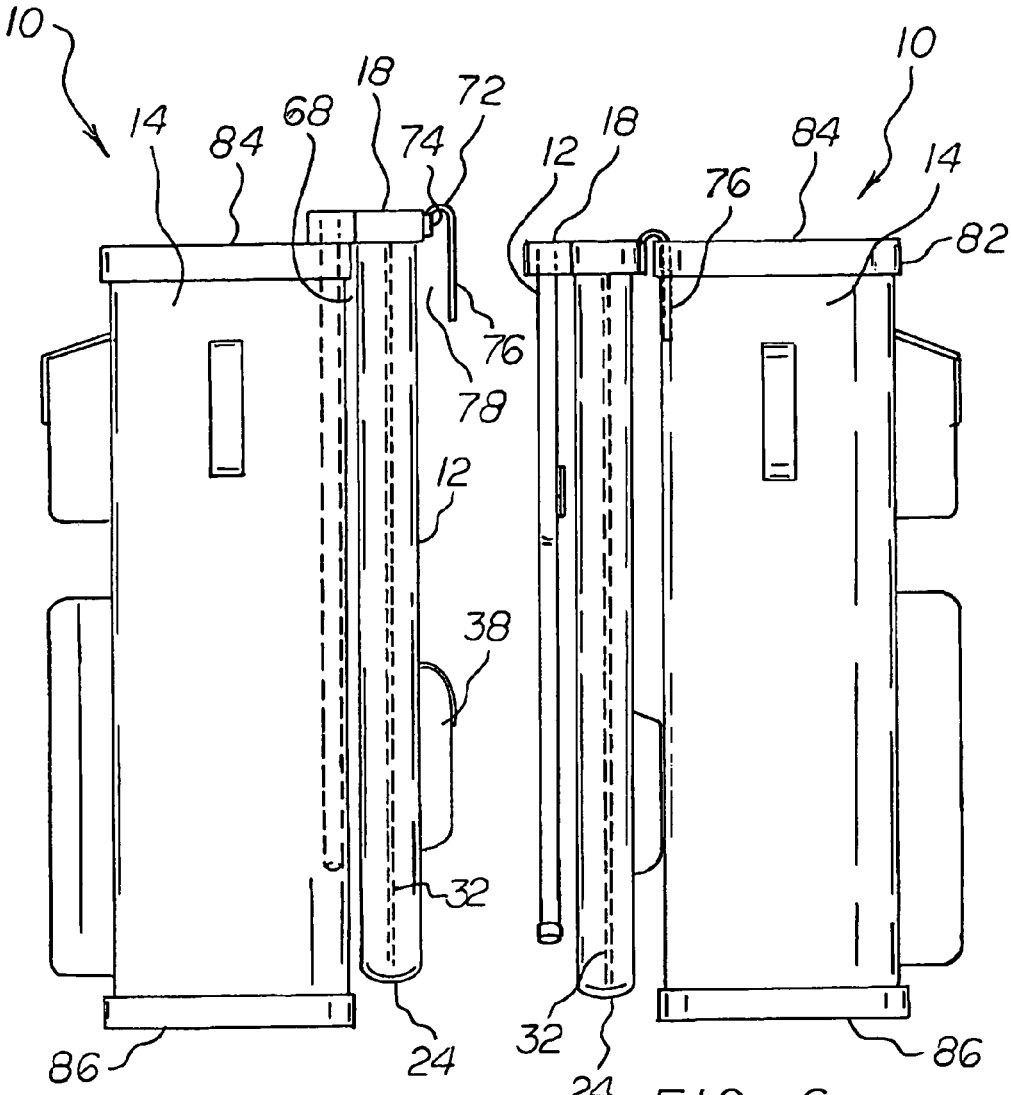
FIG. 5 is a perspective illustration of the attachable golf bag shown in FIGS. 1 through 4 in combination with a conventional golf bag in system configuration, the coupling being achieved through the legs of the attachable golf bag.
FIG. 6 is a perspective illustration of the attachable golf bag shown in FIGS. 1 through 4 in combination with a conventional golf bag in system configuration, the coupling being achieved through the hook of the attachable golf bag.

With reference now to the drawings, and in particular to FIG. 1 thereof, the preferred embodiment of the new and improved golf bag system embodying the principles and concepts of the present invention and generally designated by the reference numeral 10 will be described.

The present invention, the golf bag system 10 is comprised of a plurality of components. Such components in their broadest context include an attachable golf bag and a leg assembly. Such components are individually configured and correlated with respect to each other so as to attain the desired objective.

First provided is an attachable golf bag 12 which is of an ultra-light construction. The attachable golf bag is adapted to be releasably attached to a conventional golf bag 14. The attachable golf bag has a hollow upper tube 16. The hollow upper tube has a free upper end 18 and an exterior peripheral surface 20. The attachable golf bag 12 has a hollow lower tube 22. The hollow lower tube has a free lower end 24 and an exterior peripheral surface 26. The tubes have parallel linear side edges 28. The linear side edges are about 5 inches in length. The tubes have semicircular end edges 30. The semicircular end edges are about 2 inches in diameter. An opening having a major length of about 7 inches and a major width of about 2 inches is thus formed for receiving golf clubs. An area of about 13 square inches is provided for receiving up to 10 golf clubs. The attachable golf bag has a pair of rods 32. The rods are preferably fabricated of metal with limited flexibility. The rods are about 7 inches apart. The rods join the end edges of the upper and lower tubes. The rods hold the tubes to form an attachable golf bag about 34 inches in height, about 5 times the major length, plus or minus 10 percent and about 17 times the major width, plus or minus 10 percent. A cloth cover 34 is provided. The cloth cover encompasses the peripheral surfaces of the tubes and the area there between and the lower end of the lower tube. The cloth cover forms a tube having an open end and a closed end.

A pocket 38 is provided. The pocket is attached to the cover in proximity to the lower tube. The pocket is adapted to carry golf balls and tees and other items of interest to a golfer. A handle 40 is provided. The handle is attached to the cover in proximity to the upper tube. In this manner carrying the attachable golf bag is facilitated. Rings 42 are provided. The rings are secured to the upper and lower tubes on opposite sides of the handle. In this manner a carrying strap may be removably received.

Provided next is a leg assembly 44. The leg assembly includes an upper support 46. The upper support is attached to the upper tube on a side of the cover opposite from the pocket. The upper support has a pair of leg attachment recesses 47. The recesses are in the form of slots having rounded edges, having a somewhat oval configuration. The recesses then each have a major axis. The recesses are not parallel, with the major axises intersecting at a point.

In an another embodiment the recesses are parallel.

The leg assembly includes a pair of legs 48. The legs have upper ends 50 and free lower ends 52. The upper ends are pivotally secured to the upper support at a location spaced downwardly from the upper end of the upper tube free lower ends at a location spaced upwardly from the lower end of the lower tube. The legs are adapted to move between a retracted orientation adjacent to the cover and an extended orientation remote from the cover. The legs have upper extents 54 and lower extents 56. A bend 58 is provided between the upper and lower extents. The upper extents are adapted to converge from their upper ends when in the retracted orientation and to diverge from adjacent to the bend when in the extended orientation. The lower extents are adapted to be essentially parallel when in the retracted orientation and to diverge when in the extended orientation.

A strap 60 of a hook and loop fastener is provided. The strap is secured to the cover beneath the upper support in proximity to the lower tube. The strap has a separable section adapted to secure the legs when in a retracted orientation. A V-shaped bracket 62 is provided. The V-shaped bracket has free ends 64. The free ends are pivotally attached to the legs adjacent to the bend. The V-shaped bracket has a central pivot point 66. The central pivot point is movable between a linear horizontal position when in an extended orientation and an overlapping essentially vertical position when in a retracted orientation. The legs are pivotable with respect to the upper support remote from the cover. In this manner a downwardly facing attachment space 68 is provided for securement to a main golf bag.

Further provided is an essentially rigid hook 72. The hook is in an inverted U-shaped orientation. The hook has an interior component 74. The interior component is secured to the upper tube opposite from the upper support. The hook has an exterior leg 76. The exterior leg is spaced from the cover to create a downwardly facing attachment space 78.

Provided last is a main golf bag 14. The main golf bag has an upper end 82. The upper end has an opening 84. The opening has an area of greater than 20 square inches, greater than 150 percent of the area of the upper tube of the attachable golf bag. In this manner a larger number of golf clubs may be received than the attachable golf bag. The main golf bag has a closed lower end 86. The closed lower end supports a larger number of golf clubs. The main golf bag has a first side with a pocket 88 and an opposite second side. The opening at the second side is adapted to removably receive, in a first position, the legs of the attachable golf bag and. In a second position, the second side is adapted to receive the exterior leg of the hook.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golfing system for allowing a golfer to transport a lesser number of golf clubs in an attachable golf bag to a location remote from a main golf bag with a greater number of golf clubs comprising, in combination:

an attachable golf bag having a hollow upper tube with a free upper end and an exterior peripheral surface, the attachable golf bag having a hollow lower tube with a free lower end and an exterior peripheral surface, the tubes having parallel linear side edges about 5 inches in length with semicircular end edges about 2 inches in diameter whereby an opening having a major length of about 7 inches and a major width of about 2 inches is thus formed for receiving golf clubs and providing an area of about 13 square inches for receiving up to 10 golf clubs, the attachable golf bag having a pair of rods preferably fabricated of metal with limited flexibility, the rods are about 7 inches apart and join the end edges of the upper and lower tubes to hold the tubes and form an attachable golf bag about 34 inches in height, about 5 times the major length, plus or minus 10 percent and about 17 times the major width, plus or minus 10 percent, and a cloth cover encompassing the peripheral surfaces of the tubes and the area there between and the lower end of the lower tube;

a pocket attached to the cover in proximity to the lower tube adapted to carry golf balls and tees and other items of interest to a golfer, and a handle attached to the cover in proximity to the upper tube to facilitate carrying the attachable golf bag, and rings secured to the upper and lower tubes on opposite sides of the handle for removably receiving a carrying strap;

a leg assembly including an upper support, the upper support having a pair of recesses which each have a major axis and the axises of the recesses intersect at a point, the upper support being attached to the upper tube on a side of the cover opposite from the pocket with a pair of legs having upper ends pivotally secured to the upper support at a location spaced downwardly from the upper end of the upper tube free lower ends at a location spaced upwardly from the lower end of the lower tube, the legs being adapted to move between a retracted orientation adjacent to the cover and an extended orientation remote from the cover, the legs having upper extents and lower extents with a bend there between, the upper extents adapted to converge from their upper ends when in the retracted orientation and to diverge from adjacent to the bend when in the extended orientation, the lower extents adapted to be essentially parallel when in the retracted orientation and to diverge when in the extended orientation, and a strap of a hook and loop fastener secured to the cover beneath the upper support in proximity to the lower tube with a separable section adapted to secure the legs when in a retracted orientation, and a V-shaped bracket having free ends pivotally attached to the legs adjacent to the bend and a central pivot point movable between a linear horizontal position when in an extended orientation and an overlapping essentially vertical position when in a retracted orientation, the legs being pivotable with respect to the upper support remote from the cover to create a downwardly facing attachment space for securement to a main golf bag;

an essentially rigid hook in an inverted U-shaped orientation having an interior component secured to the upper tube opposite from the upper support and an exterior leg spaced from cover to create a downwardly facing attachment space; and a main golf bag having an upper end with an opening having an area of greater than 36 square inches, greater than 150 percent of the area of the upper tube of the attachable golf bag, for receiving a larger number of golf clubs than the attachable golf bag, and a closed lower end for supporting a larger number of golf clubs, the main golf bag having a first side with a pocket and an opposite second side, the opening at the second side adapted to removably receive, in a first position, the legs of the attachable golf bag and, in a second position, the exterior leg of the hook.

* * * * *